US008683725B2

(12) United States Patent
Munson

(10) Patent No.: US 8,683,725 B2
(45) Date of Patent: Apr. 1, 2014

(54) RECEIVER LATCHING ASSEMBLY FOR A FIREARM MAGAZINE

(76) Inventor: Seth Munson, Alexandria, VA (US)

( * ) Notice: Subject to any disclaimer, the term of this patent is extended or adjusted under 35 U.S.C. 154(b) by 115 days.

(21) Appl. No.: 13/549,089

(22) Filed: Jul. 13, 2012

(65) Prior Publication Data

US 2014/0013640 A1 Jan. 16, 2014

(51) Int. Cl.
*F41A 17/38* (2006.01)

(52) U.S. Cl.
CPC ..... *F41A 17/38* (2013.01)
USPC ..... 42/6; 89/33.1

(58) Field of Classification Search
CPC ..... F41A 17/36; F41A 17/38; F41A 9/65; F41A 9/61; B25C 1/186; F41B 11/55
USPC ..... 42/6, 49.01, 50, 49.1, 11, 17, 18, 21, 42/22; 89/33.01, 33.03, 33.1; 124/45, 52, 124/51.1; 86/38; 206/3
See application file for complete search history.

(56) References Cited

U.S. PATENT DOCUMENTS

| | | | | |
|---|---|---|---|---|
| 1,349,345 | A * | 8/1920 | Payne | 89/138 |
| 1,388,856 | A * | 8/1921 | Fox | 89/152 |
| 1,400,252 | A * | 12/1921 | Weed | 42/18 |
| 1,401,152 | A * | 12/1921 | Green | 42/50 |
| 2,081,235 | A * | 5/1937 | Hillyard | 42/18 |
| 2,710,476 | A | 6/1955 | Garand | |
| 2,997,803 | A * | 8/1961 | Florence | 42/18 |
| 3,196,568 | A * | 7/1965 | Reed | 42/18 |
| 3,574,264 | A * | 4/1971 | Simmons, Sr. | 42/6 |
| 3,715,826 | A * | 2/1973 | Seifried | 42/70.06 |
| 4,023,465 | A | 5/1977 | Inskip | |
| 4,237,638 | A * | 12/1980 | Trexler | 42/6 |
| 5,519,954 | A | 5/1996 | Garrett | |
| 5,581,926 | A * | 12/1996 | Taalib-din et al. | 42/16 |
| 6,952,895 | B1 * | 10/2005 | Zonshine | 42/70.02 |
| 7,219,462 | B2 | 5/2007 | Finn | |
| 7,261,029 | B1 | 8/2007 | Davis | |
| D603,012 | S | 10/2009 | Fitzpatrick et al. | |
| 7,921,587 | B2 | 4/2011 | Mayberry | |
| D640,766 | S | 6/2011 | Joplin | |
| 8,051,595 | B2 | 11/2011 | Hochstrate et al. | |
| 8,122,632 | B2 * | 2/2012 | Bentley | 42/6 |
| 8,127,480 | B1 | 3/2012 | McManus et al. | |
| 8,156,930 | B2 * | 4/2012 | Hu | 124/71 |
| 8,191,298 | B2 * | 6/2012 | Cash et al. | 42/50 |
| 2005/0000138 | A1 | 1/2005 | Kiss | |
| 2006/0026883 | A1 | 2/2006 | Hochstrate et al. | |
| 2006/0265925 | A1 | 11/2006 | Murello | |
| 2011/0036232 | A1 | 2/2011 | Dublin | |
| 2011/0232148 | A1 | 9/2011 | Cain et al. | |
| 2012/0255209 | A1 * | 10/2012 | Klassen | 42/6 |

* cited by examiner

*Primary Examiner* — Bret Hayes
*Assistant Examiner* — Joshua Freeman
(74) *Attorney, Agent, or Firm* — Erickson, Kernell, Derusseau & Kleypas, LLC

(57) ABSTRACT

A magazine-latching assembly for a firearm is described. The magazine-latching assembly includes a latch body that is slideably disposed in a receiver. The latch body includes a notch that accepts an aft tab on a magazine. A locking member is pivotally disposed in the latch body and engages the receiver to lock the latch body in a forward position in which the magazine is locked into the receiver. The assembly includes a magazine-release lever that forms a portion of a trigger guard. Actuation of the magazine-release lever pivots the locking member out of engagement with the receiver, moves the latch body out of engagement with the aft tab of the magazine, and draws the forward tab of the magazine out of engagement with the receiver. The magazine-latching assembly is useable with twin-tab magazines and with bullpup-style firearms. The magazine-release lever is also configured for ambidextrous operation of the firearm.

23 Claims, 11 Drawing Sheets

RECEIVER LATCHING ASSEMBLY FOR A FIREARM MAGAZINE

BACKGROUND

Ammunition magazines are well known for use with automatic and semi-automatic firearms like rifles, shotguns, and handguns, among others. Configurations of such magazines are as numerous as the firearms with which they are used. Some are designed for use with a specific firearm while others are useable with a variety of firearms. Other design features include the size and number of ammunition cartridges that can be inserted into the magazine, components configured to feed the cartridges into the firearm, and components and configurations adapted to retain the magazine in a magazine receiver well of the firearm.

One of the most well-known firearms worldwide is the Kalashnikov or AK-47 and variants thereof originally developed by Mikhail Kalashnikov of the Soviet Union (USSR) in 1947. The AK-47 employs an ammunition magazine that includes a forward and an aft tab for retention of the magazine in a receiver of the firearm. Insertion of the magazine into the AK-47 receiver requires placement of the front tab in contact with a mating flange in the receiver and then rotation of the magazine about the front tab to engage the aft tab with a pivoting spring-loaded clasp located at a rearward portion of the receiver well. Similarly, removal of the magazine from the AK-47 receiver requires a user to first release one hand from the firearm, actuate a release for the clasp, and then pull or allow gravity to move the magazine downward while rotating it about the forward tab. This rotation and clasp release can be slow, especially in combat situations, and places design constraints on firearms due to the space required to rotate the magazine into/out of the receiver.

It is estimated that over 100 million rifles based on the AK-47 design have been produced worldwide. The number of magazines manufactured for AK-type rifles thus far exceeds 100 million. It would be advantageous to enable use of magazines produced for AK-type rifles with other firearms without modification of the magazines. It would also be advantageous to enable removal of non-modified AK- and other dual-tab type magazines, e.g. magazines having a forward and an aft tab, from a receiver of a firearm and insertion of a replacement magazine therein without requiring rocking or rotation of the magazine relative to the firearm and without the user having to release the firearm.

SUMMARY

Embodiments of the invention are defined by the claims below, not this summary. A high-level overview of various aspects of the invention are provided here for that reason, to provide an overview of the disclosure, and to introduce a selection of concepts that are further described in the Detailed-Description section below. This summary is not intended to identify key features or essential features of the claimed subject matter, nor is it intended to be used as an aid in isolation to determine the scope of the claimed subject matter.

In brief, this disclosure describes, among other things, a magazine-latching assembly for a firearm. The assembly includes a receiver that receives a magazine and that includes a latch body slideably disposed therein. The latch body is moveable along the length of the firearm and includes a notch in a forward face thereof that is configured to accept an aft tab on the magazine. A locking member is disposed in the latch body and is pivotable between a first position in which the locking member engages the receiver to restrict rearward movement of the latch body and a second position in which the locking member is disengaged from the receiver and the latch body can freely move.

To release a magazine from the receiver, a magazine-release lever is actuated to move the locking member to the second position and to subsequently move the latch body rearwardly. This movement draws the magazine slightly rearwardly to disengage the forward tab of the magazine from engagement with a lip on a forward wall of the receiver. The movement also disengages the latch body from the aft tab of the magazine thereby enabling removal of the magazine from the receiver.

Insertion of the magazine into the receiver first pivots the locking member to the second position via contact between the locking member and the aft tab of the magazine. Continued insertion of the magazine into the receiver causes contact between the aft tab and a cam surface on the latch body. Thereby, the latch body is moved rearwardly to allow the aft tab to pass. Upon alignment of the aft tab with the notch in the latch body, the latch body again moves forward to engage the aft tab and allow the locking member to return to the first position. The latch body is thus locked in a forward position engaging the aft tab and the magazine is locked into the receiver. The forward movement of the latch body also moves or follows the magazine slightly forward to engage the forward tab with the lip on the forward wall of the receiver.

The magazine-latching assembly is configured to accept a magazine having both a forward and an aft tab. The assembly enables insertion and removal of the magazine to follow a path that is substantially perpendicular to the length of the firearm and does not require rocking or rotation of the magazine. Firearms utilizing the assembly of embodiments of the invention can thus be designed with tighter clearances around the magazine and common, highly available dual-tab magazines can be used without modification thereof. The assembly is also configurable for use in firearms having a bullpup design, e.g. designs in which the magazine is located rearward of the trigger.

DESCRIPTION OF THE DRAWINGS

Illustrative embodiments of the invention are described in detail below with reference to the attached drawing figures, and wherein.

DETAILED DESCRIPTION

Figure 1:
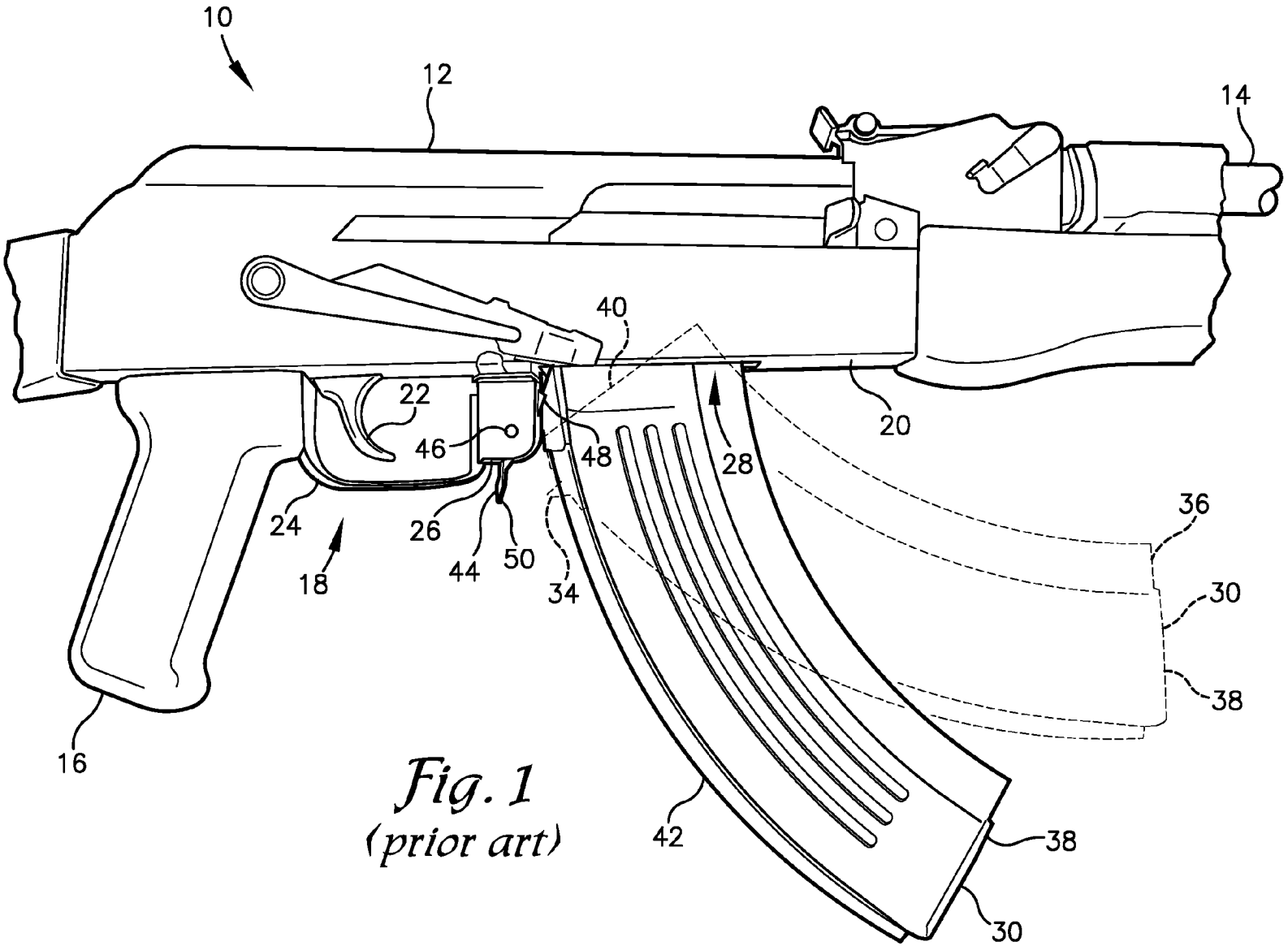
Fig. 1 (prior art)
FIG. 1 is an elevational view depicting an AK-47 rifle of the prior art with positions of a magazine during installation/removal into a receiver of the rifle shown in phantom.

The subject matter of select embodiments of the invention is described with specificity herein to meet statutory requirements. But the description itself is not intended to necessarily limit the scope of claims. Rather, the claimed subject matter might be embodied in other ways to include different components, steps, or combinations thereof similar to the ones described in this document, in conjunction with other present or future technologies. Terms should not be interpreted as implying any particular order among or between various steps herein disclosed unless and except when the order of individual steps is explicitly described.

Embodiments of the invention are described herein with respect to a magazine configured for use with an AK-47 or variants thereof. However, embodiments of the invention are not so limited—embodiments can be configured for use with other dual- and single-tab type magazines. Embodiments are also configurable for use with a variety of automatic and semi-automatic rifles, shotguns, handguns and associated ammunition.

For sake of clarity, embodiments of the invention are described with respect to a standard shooting orientation of a firearm, e.g. one in which the firearm is held with a barrel thereof in a substantially horizontal orientation and with a trigger located on an underside of the firearm. The forward end of the firearm is defined as the end from which a fired round exits the firearm and the aft or rear end is defined as the end opposite the forward end and closest to a user operating the firearm.

Further, embodiments of the invention are described with respect to a bullpup-style firearm in which a magazine receiver well is located on an underside of the firearm rearward of a trigger thereof and in which a magazine is inserted from beneath the firearm in an upward motion. However, embodiments of the invention are not so limited—embodiments are configurable for use in firearms with magazine receiver wells disposed in any position on the firearm and in any orientation, such as vertically above a trigger assembly and along a side of the firearm to enable sideways insertion of a magazine.

With initial reference to FIGS. 1-2, a Kalashnikov or AK-47 (hereinafter AK-47) firearm 10 of the prior art is described. The AK-47 10 includes a body 12 with a barrel 14, a grip 16, and a trigger assembly 18 mounted thereon. The grip 16 extends from a bottom surface 20 of the body 12 and abuts an aft side of the trigger assembly 18. The trigger assembly 18 includes a trigger 22 and a trigger guard 24 that surrounds the trigger 22 longitudinally parallel to the length of the body 12. A spring-biased clasp 26 is mounted on a forward portion of the trigger guard 24 and adjacent a magazine receiver well 28. The magazine receiver well 28 is disposed forward of the trigger assembly 18 and in the bottom surface 20 of the body 12. The magazine receiver well 28 is configured to accept a magazine 30 having a forward tab 32 and an aft tab 34 extending therefrom.

Figure 2:
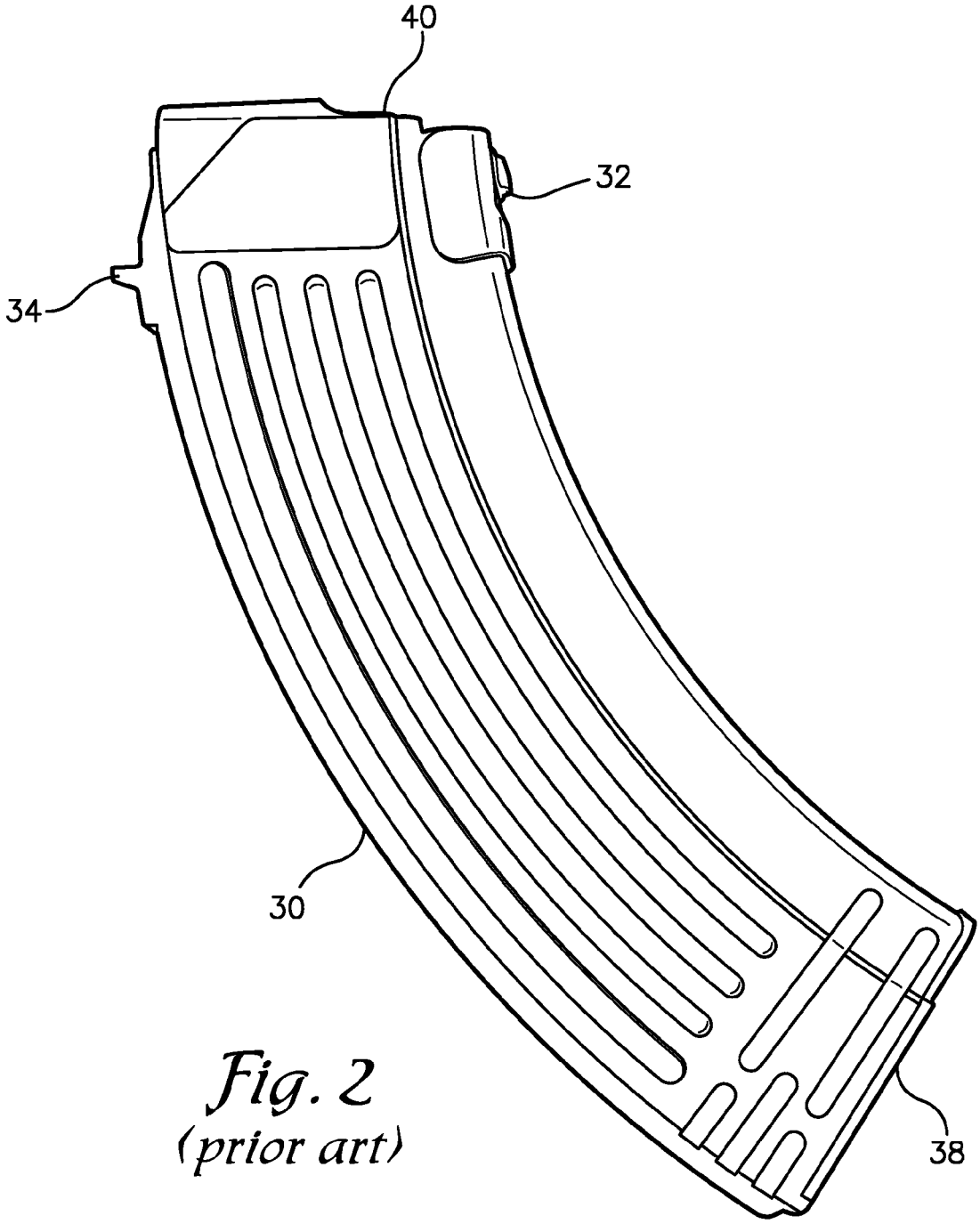
Fig. 2 (prior art)
FIG. 2 is an elevational view depicting a magazine of an AK-47 rifle of the prior art.

As depicted by phantom lines in FIG. 1, insertion of the magazine 30 into the magazine receiver well 28 first requires placement of the magazine 30 in a first position 36 in which the forward tab 32 is disposed above a flange (not shown) within the well 28 and a base 38 of the magazine 30 is rotated forwardly. The base 38 of the magazine 30 is then rotated rearwardly about the forward tab 32 to rotate a top end 40 of the magazine 30 upwardly into the well 28 and to move the magazine 30 to a second position 42.

Rotation of the magazine 30 about the forward tab 32 causes the aft tab 34 on the magazine 30 to engage the clasp 26. The aft tab 34 contacts a spring-biased retaining lever 44 to rotate the lever 44 about a pivot 46 and to allow the aft tab 34 to pass by. Upon passing a first end 48 of the lever 44, the lever 44 is biased to return to an original position and obstructs return movement of the aft tab 34. The magazine 30 is thus locked in the receiver well 28.

Removal of the magazine 30 from the receiver well 28 requires a user to use a free hand to press a second end 50 of the retaining lever 44 forward thereby, moving the first end 48 out of engagement with the aft tab 34. The magazine 30 is then rotated from the second position 42 to the first position 36 about the forward tab 32 and is subsequently withdrawn from the receiver well 28.

The requirement of alignment of the forward tab 32 with the flange in the well 28 and the rotation about the tab 32 for insertion and removal of the magazine 30 from the well 28 can have deleterious effects on the rate at which magazines 30 can be exchanged in the AK-47 10 and similarly designed firearms. For example, misalignment of the forward tab 32 requires a user to start over and reattempt insertion of the magazine 30. And during removal of the magazine 30, engagement of the forward tab 32 with the flange in the well 28 can cause hang-ups if the magazine 30 is not fully rotated out of engagement. These issues can be frustrating and dangerous to users of the firearm 10 when in a life-or-death combat situation.

Further still, two hands are required to release the magazine 30—one hand to hold the firearm 10 and the second to depress the retaining lever 44. This leads to the firearm 10 being moved out of a fire-ready position during the magazine exchange. Thus, time between exhaustion of a first magazine 30 to firing a round from a second magazine 30 is increased because the user must also reposition the firearm 10 before firing. These movements also distract the user from the ongoing situation and surroundings—increasing the danger thereof.

Additionally, the necessity to rotate the magazine 30 about the forward tab 32 results in clearance issues that affect design of firearms using the magazine 30 in a similar manner. Not only must such designs provide clearance for the magazine 30 but there must also be room to allow sufficient rotation of the magazine 30 for insertion and removal into the magazine-receiver well 28.

Turning now to FIGS. 3-7, a firearm 100 having a magazine-latching assembly 102 is described in accordance with an embodiment of the invention. The firearm 100 is configured in a bullpup design in which a magazine receiver 103 is located rearwardly of a grip 104 and a trigger 106. However, as discussed previously above the firearm 100 can have any of a variety of configurations. The firearm 100 includes an upper housing 108, a lower housing 110, a barrel 112, a charging handle 114, a shock-absorbing stock 116, and may include an optical sight 118.

Figure 4:
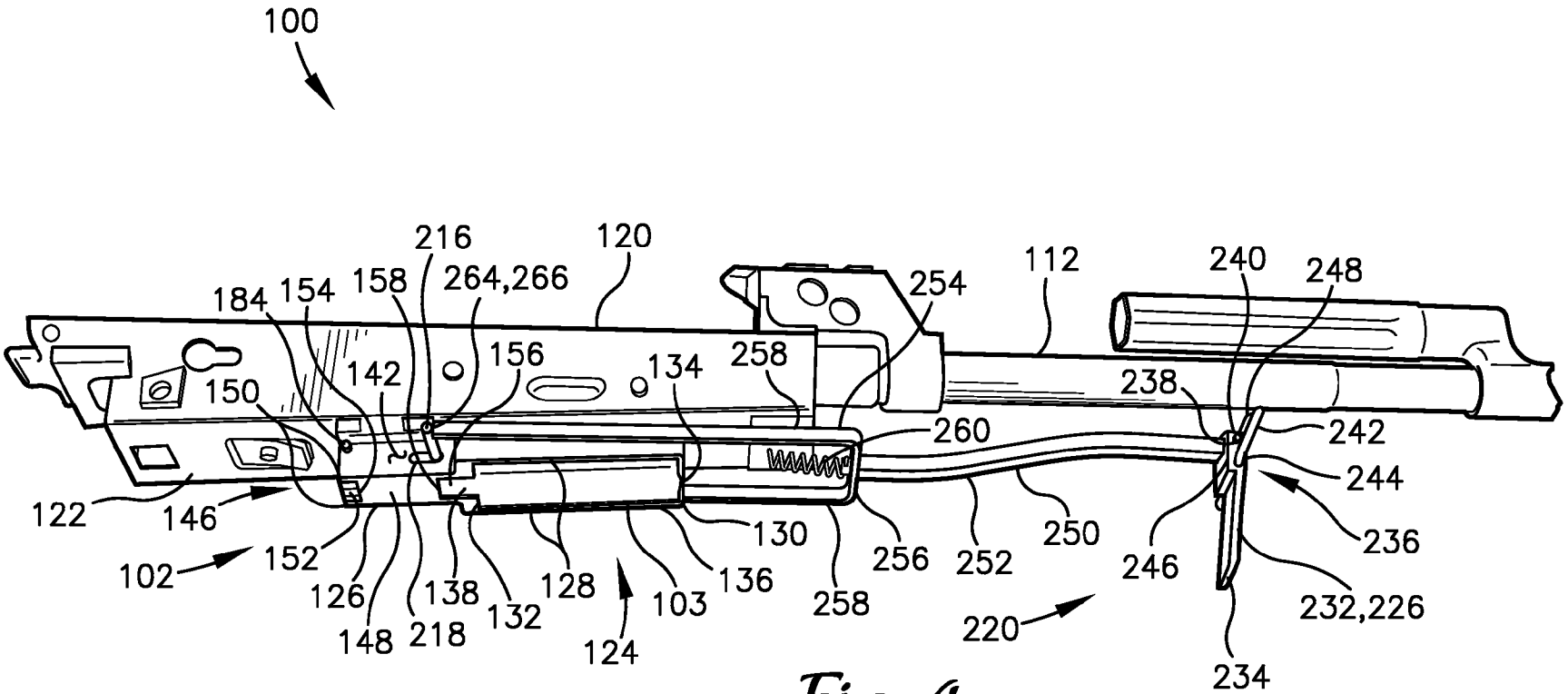
FIG. 4 is perspective side view of interior components of the firearm of FIG. 3 depicting components of a magazine-latching assembly in accordance with an embodiment of the invention.
Figure 5:
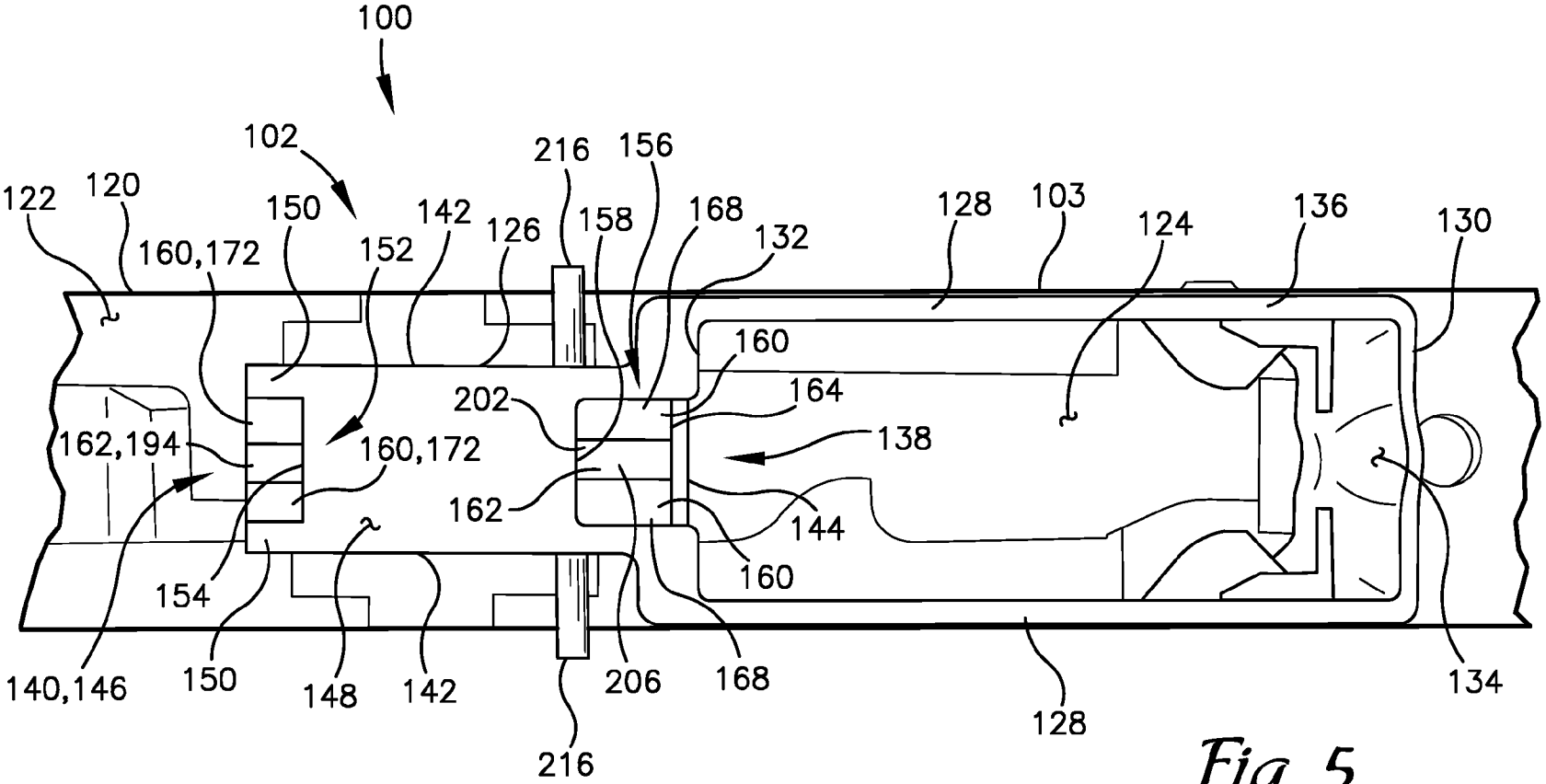
FIG. 5 is a perspective bottom view of the interior components of the firearm of FIG. 4 depicting a magazine receiver well and a magazine-latching assembly in accordance with an embodiment of the invention.
Figure 6A:
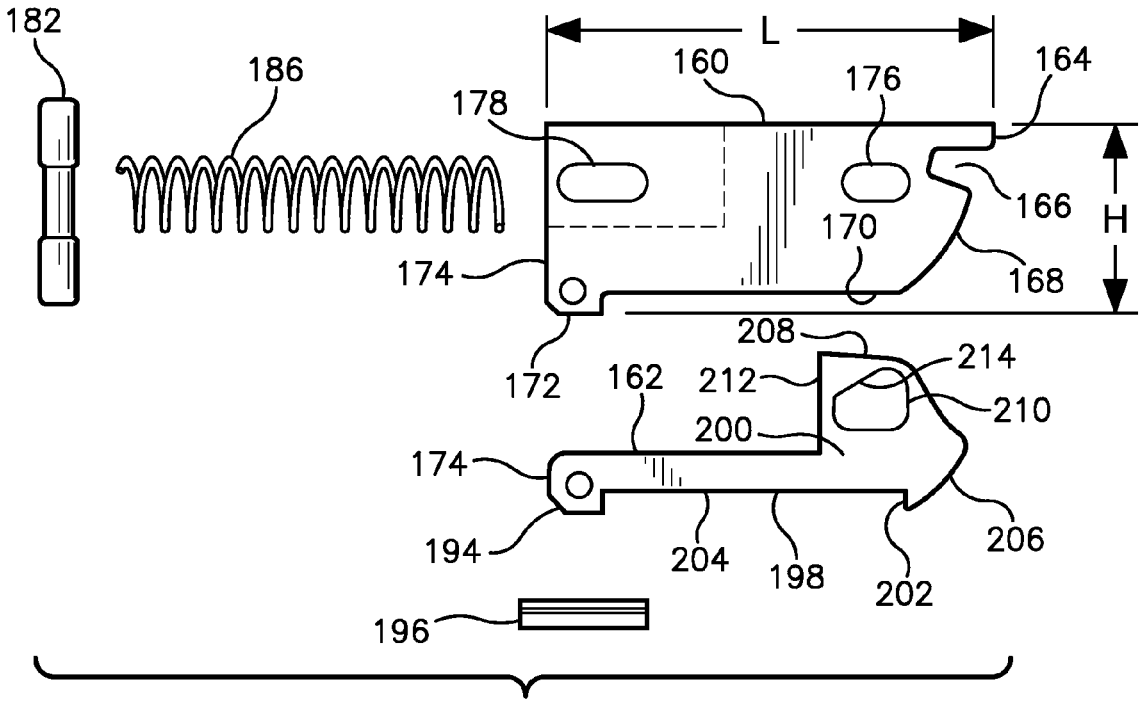
FIG. 6A is a side elevational view depicting components of the magazine latching assembly of the firearm of FIG. 3 in a disassembled condition in accordance with an embodiment of the invention.
Figure 6B:
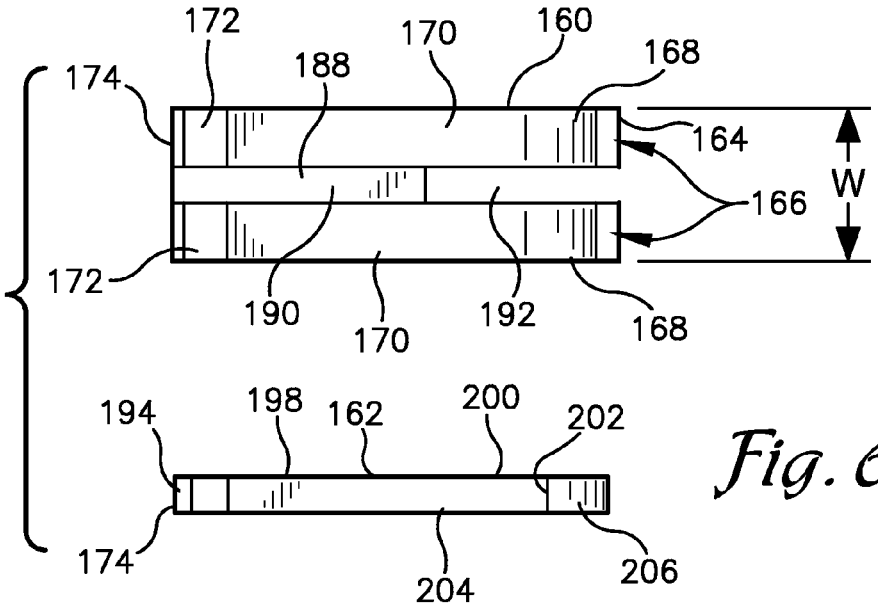
FIG. 6B is a bottom side elevational view of the latch body and locking member of FIG. 6A.
Figure 6C:
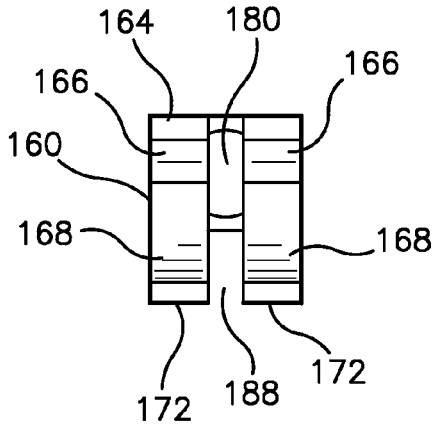
FIG. 6C is an elevational view of a first end of the latch body of FIG. 6A.
Figure 6D:
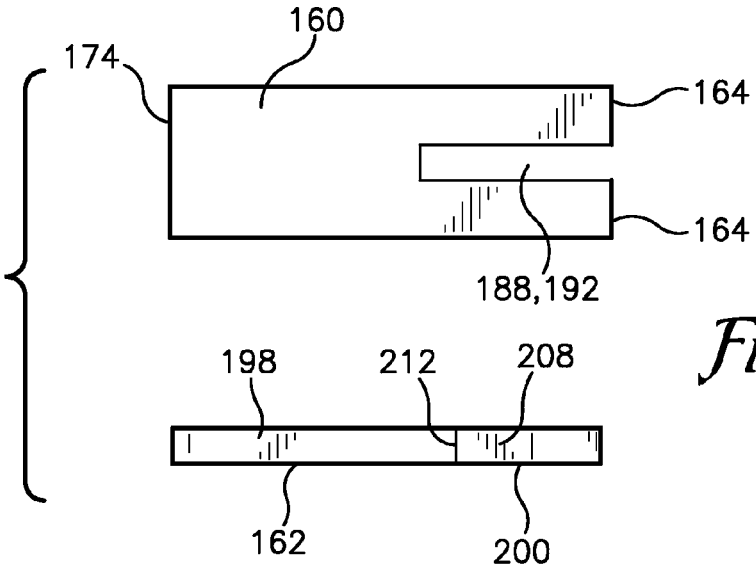
FIG. 6D is a top side elevational view of the latch body and locking member of FIG. 6A.
Figure 6E:
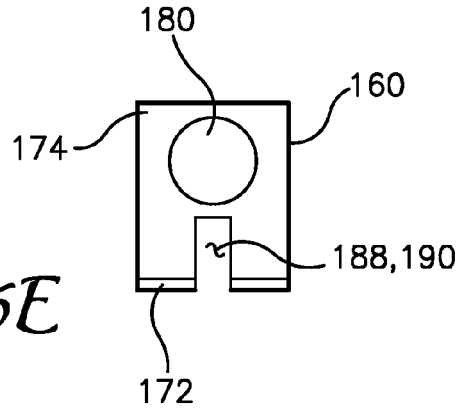
FIG. 6E is an elevational view of a second end of the latch body of FIG. 6A.

An interior housing 120 is depicted in FIGS. 4 and 5 with the upper and lower housings 108, 110 removed from the firearm 100. The interior housing 120 houses one or more components (not shown) configured for operation of the firearm 100, such as receiving an ammunition cartridge, detonating the cartridge, and ejecting a spent cartridge from the firearm 100. The handling and firing of ammunition cartridges is not important to an understanding of the latching assembly 102 of embodiments of the invention and is not further described herein.

The magazine receiver 103 extends from a bottom surface 122 of the interior housing 120 and protrudes through an aperture 123 in the lower housing 110. The receiver 103 includes a magazine well 124 and a latch housing 126. The magazine receiver 103 is configured to accept the magazine 30 depicted in FIG. 2. The magazine 30 is configured for use in an AK-47 as discussed previously and includes the forward tab 32 and the aft tab 34 located near the top end 40 of the magazine 30, e.g. the magazine 30 is not modified. The magazine 30 has a curved or banana-shaped profile but might have a linear or other profile or configuration. In another embodiment, the magazine 30 is configured specifically for the firearm 100 or for another firearm and excludes one of the forward or aft tabs 32, 34.

The magazine well 124 is formed by a pair of side walls 128, a forward wall 130, and an aft wall 132 that define a cavity, magazine well 124, with a generally rectangular cross-section dimensioned to accept the top end 40 of the magazine 30 and the forward and aft tabs 32, 34 therein. The magazine well 124 includes any space in which the magazine 30 and the forward and aft tabs 32, 34 are disposed within the receiver 103 or through which the magazine 30 and tabs 32, 34 pass during insertion into or removal from the well 124. The forward wall 130 includes an recessed channel or groove 134 formed on an inner surface thereof that extends from an outer or lower edge 136 inward or upward a distance along the wall 130 and terminates at an inner edge or lip 135 interior to the well 124. The recessed channel 134 is dimensioned to partially accept the forward tab 32 of the magazine 30 therein to aid travel in a sliding motion along the forward wall 130 as described more fully below. The depth of the recessed channel 134 into the forward wall 130 is also configured to provide the lip 135 that is engageable by the forward tab 32, e.g. the depth of the recessed channel 134 is less than the distance that the forward tab 32 extends from the magazine 30.

The aft wall 132 of the magazine well 124 is integral with the latch housing 126 and has a cutout 138 removed from a central portion of the aft wall 132 that extends from the lower edge 136 of the receiver 103 a distance along the wall 132. The cutout 138 is open to an interior passage 140 that extends rearwardly along the length of the firearm 100 through the latch housing 126.

The latch housing 126 is formed by a pair of sidewalls 142 extending from and below the bottom surface 122 of the interior housing 120 or from a top wall 144 that is coupled to the bottom surface 122, an open forward end formed by the cutout 138, an open aft end 146, and a lower wall or base plate 148 that extends between distal edges 150 of the sidewalls 142. The lower wall 148 is shorter in length than the sidewalls 142 such that an aft notch 152 is formed by an aft end 154 of the base plate 148 and a portion of the distal edges 150 of the sidewalls 142. Additionally, a forward notch 156 is formed by a forward edge 158 of the base plate 148 and the distal edges 150 of the sidewalls 142. The forward notch 156 extends rearwardly from the notch 138 in the aft wall 132 of the well 124 and is thus open to and forms a part of the well 124.

Within the latch housing 126 are disposed a latch body 160 and a locking member 162 as best depicted by FIGS. 6A-E. The latch body 160 is adapted to engage and connect with an aft tab 34 of a magazine 30 and the locking member 162 is adapted to releasably engage the receiver to prevent inadvertent rearward movement of the latch body 160 such as through the transmission of a rearwardly directed force through the magazine 30 upon recoiling of the firearm 100. The latch body 160 is dimensioned to be disposed in the open passage 140 in the latch housing 126 and to be slideably moveable forward and rearward along the length L of the latch body 160. A forward end 164 of the latch body 160 includes a tab-support surface or notch 166 and a cam surface 168. The tab-support surface or notch 166 is configured to accept the aft tab 34 of the magazine 30 therein. In an embodiment, the notch 166 comprises a tab-support surface that engages the aft tab 34 in an underlying relationship in which the tab-support surface lies beneath the aft tab 34 and obstructs travel of the aft tab 34 from the well 124. The cam surface 168 extends from a lower surface 170 of the latch body 160 to the notch 166 in an upwardly and forwardly angled or curvilinear path. A foot or flange 172 extends from the lower surface 170 of the latch body 160 at a rearward end 174 thereof.

A first elongate or ovate aperture 176 is formed through latch body 160 adjacent the forward end 164 and across the width W of the latch body 160. A second elongate or ovate aperture 178 is disposed through the latch body 160 near the rearward end 134 and across the width W. The direction of elongation of both the first and second apertures 176 and 178 is parallel to or along the length L of the latch body 160 and the direction of sliding of the latch body within the latch housing 126.

A spring receiving bore 180 is formed in the latch body 160 and extends from the rearward end 174 of the latch body toward the forward end 164 thereof. The second aperture 178 extends across the spring receiving bore 180 with a central axis of aperture 178 and bore 180 extending in a common plane. The second aperture 178 is also configured to accept a retaining pin 182 therethrough and to allow the retaining pin 182 to move in the direction of elongation of the second aperture 178.

The retaining pin 182 is of sufficient length to extend across the width W of the latch body 160 and to engage apertures 184 in the sidewalls 142 of the latch housing 126.

Thereby, the retaining pin 182 couples the latch body 160 to the latch housing 126 and restricts the sliding movement of the latch body 160 to that allowed by the elongation of the second aperture 178. The retaining pin 182 also obstructs removal of a coil spring 186 from the rearward end 174 of the bore 180.

The latch body 160 includes a channel or groove 188 formed along its length L and located centrally relative to its width W. A rearward portion 190 of the channel 188 extends only partially through the latch body 160 upwards from the lower surface 170 thereof a first distance along the height H of the latch body 160, without intersecting the bore 180. A forward portion 192 of the channel 188 extends the full height H of the latch body 160.

The locking member 162 is configured for receipt in the channel 188 of the latch body 160. The rearward end 174 of the locking member 162 includes a foot or flange 194 similar to the foot 172 on the latch body 160. An aperture 196 is formed through the locking member 162 and the latch body 160 adjacent to the rearward ends 174 and the feet 172, 194. The aperture 196 is configured to receive a pin 198 to pivotally couple the locking member 162 within the channel 188 of the latch body 160. An arm 198 extends from the foot 194 forwardly to an enlarged head 200 of the locking member 162. The arm 198 is configured to pivot about the pin 196 and within the rearward portion 190 of the channel 188. The enlarged head 200 is configured to pivot within the forward portion 192 of the channel 188.

The enlarged head 200 includes a locking flange or tooth 202 extending from a lower surface 204. A forward surface of the locking tooth 202 forms a cam surface 206 that extends from the tooth 202 in an angled or curvilinear direction toward a top 208 of the locking member 162. The cam surface 206 of the locking member 162 extends slightly forward of the cam surface 168 of the latch body 160. The enlarged head 200 also includes a rearward face 212 configured to abut a forward end of the coil spring 186 disposed in the bore 180. An actuation aperture 210 formed through the enlarged head 200 accepts an actuation rod or transverse linkage 216 that is inserted through associated elongate apertures 218 in the sidewalls 142 of the latch housing 126 and through the first elongate apertures 176 in the latch body 160. A portion of the perimeter of the actuation aperture 210 forms a lock-actuating cam surface 214.

One of skill in the art will recognize other configurations of the latch body 160 and locking member 162 among other components that are useable to perform the same or similar functions as described herein. For example, the latch body 160 might be configured with recessed slots or channels (not shown) in place of one or more of the first and second elongate apertures 176, 178. Such configurations are within the scope of embodiments of the invention described herein.

Figure 3:
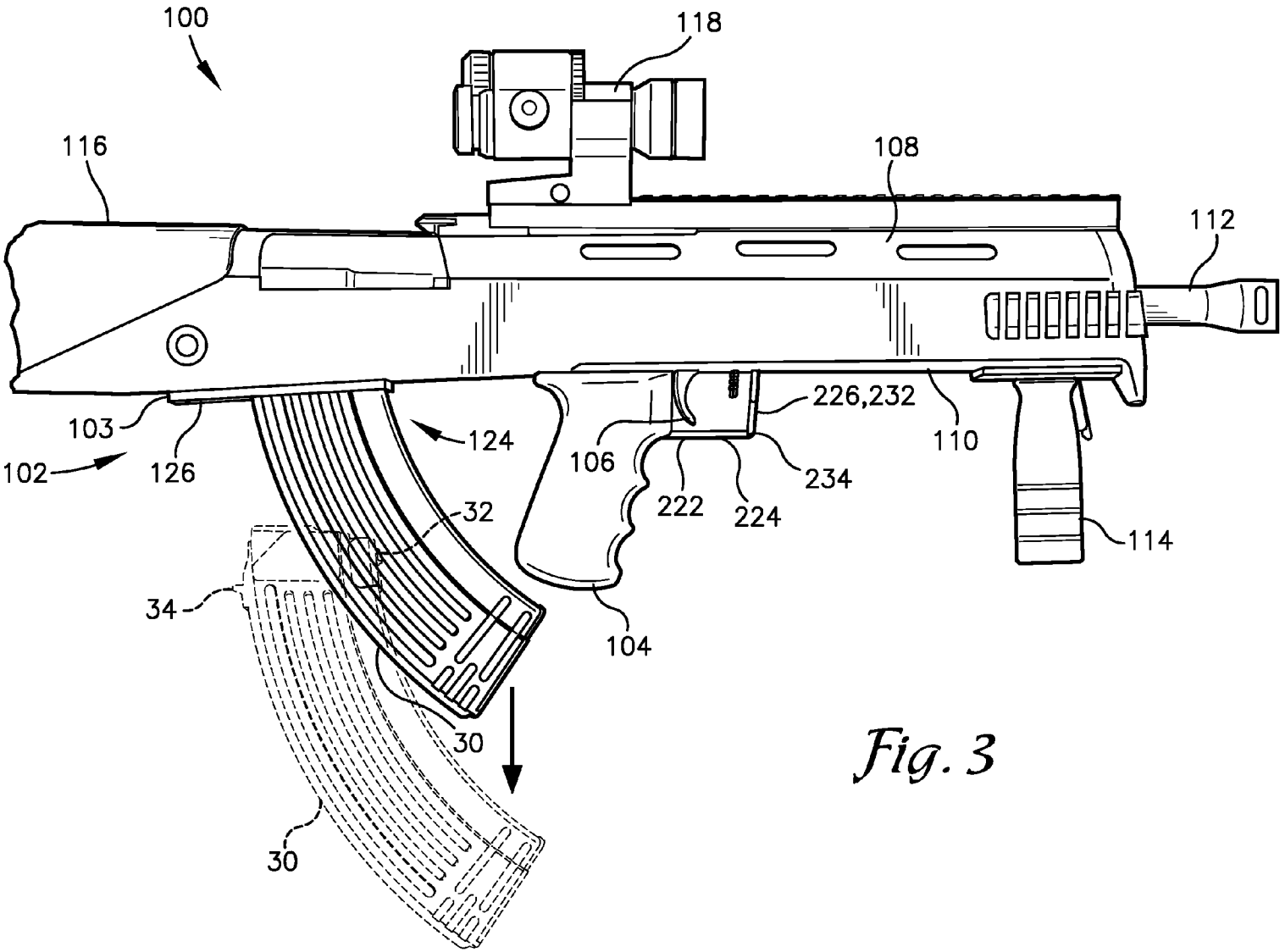
FIG. 3 is an elevational view depicting a firearm having an improved magazine latching assembly in accordance with an embodiment of the invention.
Figure 7:
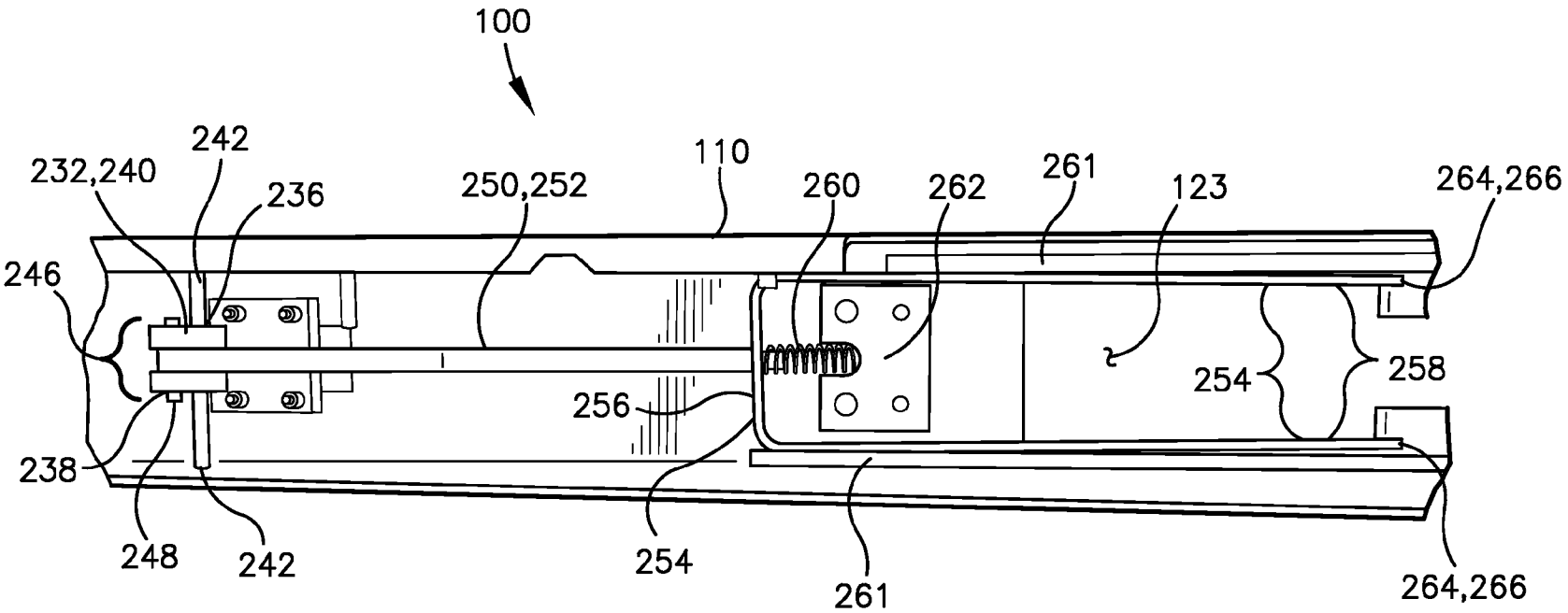
FIG. 7 is top plan view of a lower housing of the firearm of FIG. 3 depicting components of the magazine latching assembly in accordance with an embodiment of the invention.

With reference now to FIGS. 3-4 and 7, a magazine-release sub-assembly 220 of the magazine-latching assembly 102 is described in accordance with an embodiment of the invention. The magazine-release sub-assembly 220 is associated with a trigger guard 222 of the firearm 100 which is best seen in FIG. 4. In another embodiment, the magazine-release sub-assembly 220 may employ a lever or other release mechanism that is not part of the trigger guard. The trigger guard 222 includes a first and a second portion 224, 226 and is configured to aid in preventing inadvertent contact with the trigger 106 or obstruction of movement of the trigger 106. The first portion 224 comprises a rigid flange extending forwardly from a grip 104 below the trigger 106. The second portion 226 comprises a magazine-release lever 232, button, or other actuator that is pivotally coupled to the lower housing 110 of the firearm 100 and extends from the lower housing 110 to contact the first portion 224 at a distal end 234. In an alternative embodiment (not shown), the trigger guard 222 may comprise a single piece that also forms the magazine release-lever 232.

As depicted in FIGS. 4 and 7, the magazine-release lever 232 is pivotally connected to the lower housing 110 by a pivot pin or rod 242. The rod 242 is connected to the lower housing 110 and extends through an aperture 244 in the magazine release lever 232 that is generally centrally located along the length of the lever 232. A clevis 246 is formed on an upper end of the magazine-release lever 232. A first portion or stem 250 of a forked, actuation member 252 is pivotally secured to the clevis 246 by a pin 248 extending through the clevis 246 and the stem 250.

The stem 250 of the actuation member 252 extends rearwardly along the length of the firearm 100 to a bifurcated second portion or fork 254. The stem 250 is connected to a cross-member 256 of the fork 254 in front of the magazine receiving well 124. A pair of spaced apart arms 258 extend rearwardly from the cross-member 256 along opposite sides of the magazine receiving well 124 and to the transverse linkage 216 of the magazine-latching assembly 102 such that distal ends 264 of the arms extend in close proximity or abutting relationship to the transverse linkage 216 on opposite sides thereof. In another embodiment, the actuation member 252 comprises a single, non-bifurcated member extending only on one side of the well 124 or comprises one or more flexible cables, members, or components, or a linkage thereof that provides the same or similar function as described herein below. Such embodiments are within the scope described herein.

A coil spring 260 is positioned between the cross-member 256 and a stationary block or abutment 262 mounted or formed on the lower housing 110 to bias the actuation member 252 in a forward direction. The lower housing 110 might include one or more features, such as flanges or tracks 261 to guide forward and rearward movement of the arms 258 of the actuation member 252.

Distal ends 264 of the arms 258 are squared off to provide a flat contact surface 266 or might include convex or rounded cutouts to aid in guiding contact between the distal ends 264 and the rod 216 of the magazine-latching assembly 102. Alternatively, the distal ends 264 of arms 258 may be connected to the transverse linkage 216.

Figure 8A:
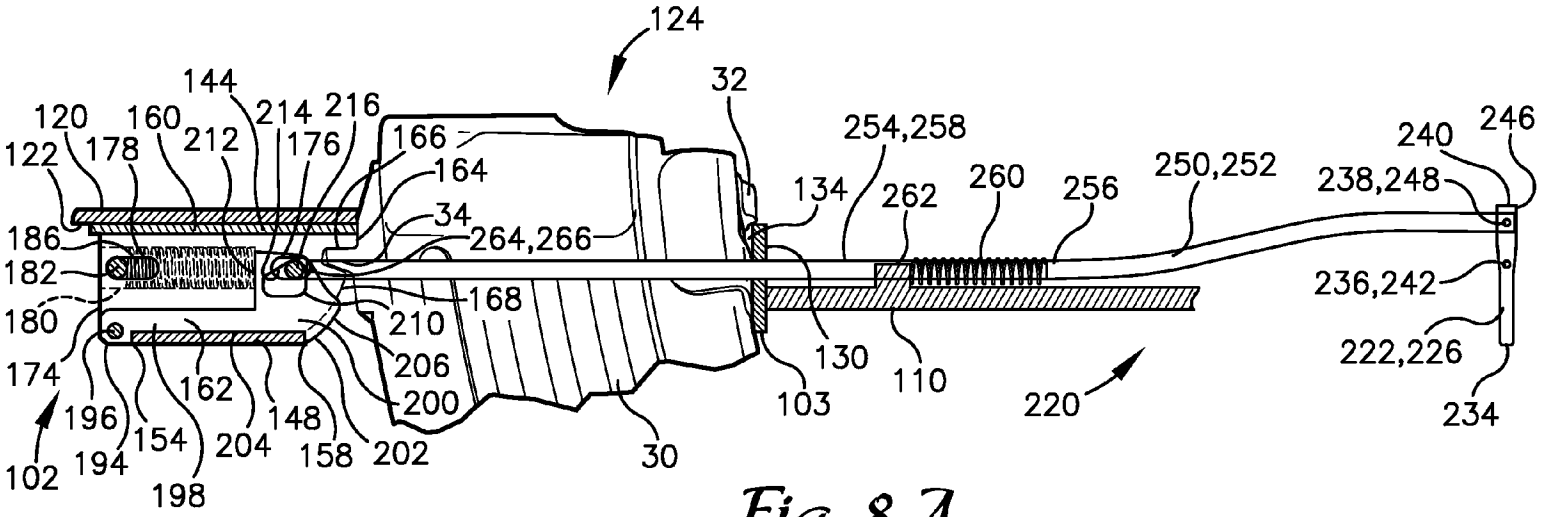
FIG. 8A is a diagram depicting a cutaway side view of the magazine latching assembly of the firearm of FIG. 3 with a magazine locked in a magazine receiver well in accordance with an embodiment of the invention.
Figure 8B:
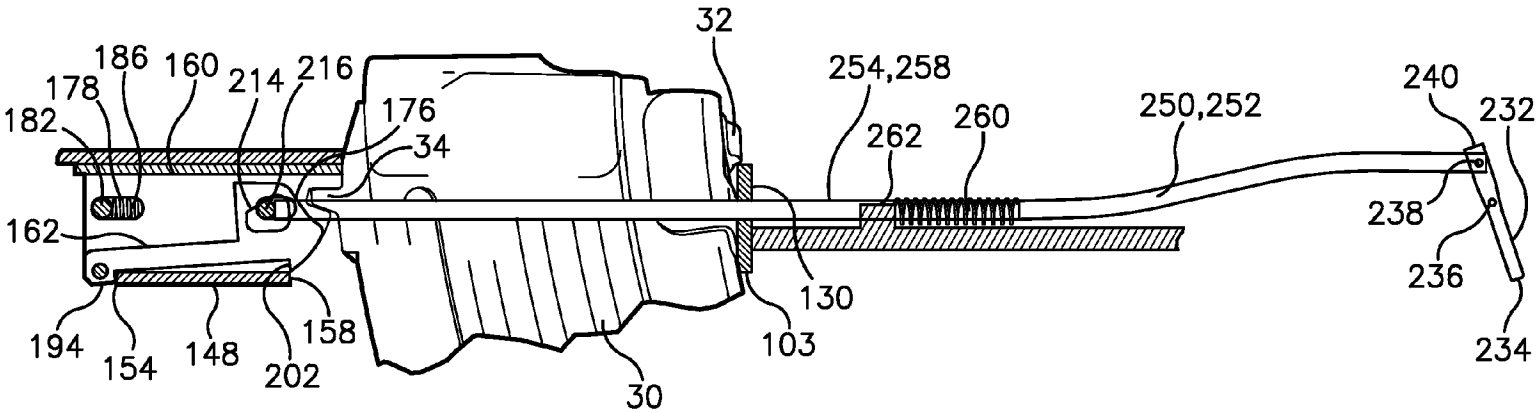
FIG. 8B is a diagram depicting a cutaway side view of the magazine latching assembly of FIG. 8A with the locking member in an unlocked position in accordance with an embodiment of the invention.
Figure 8C:
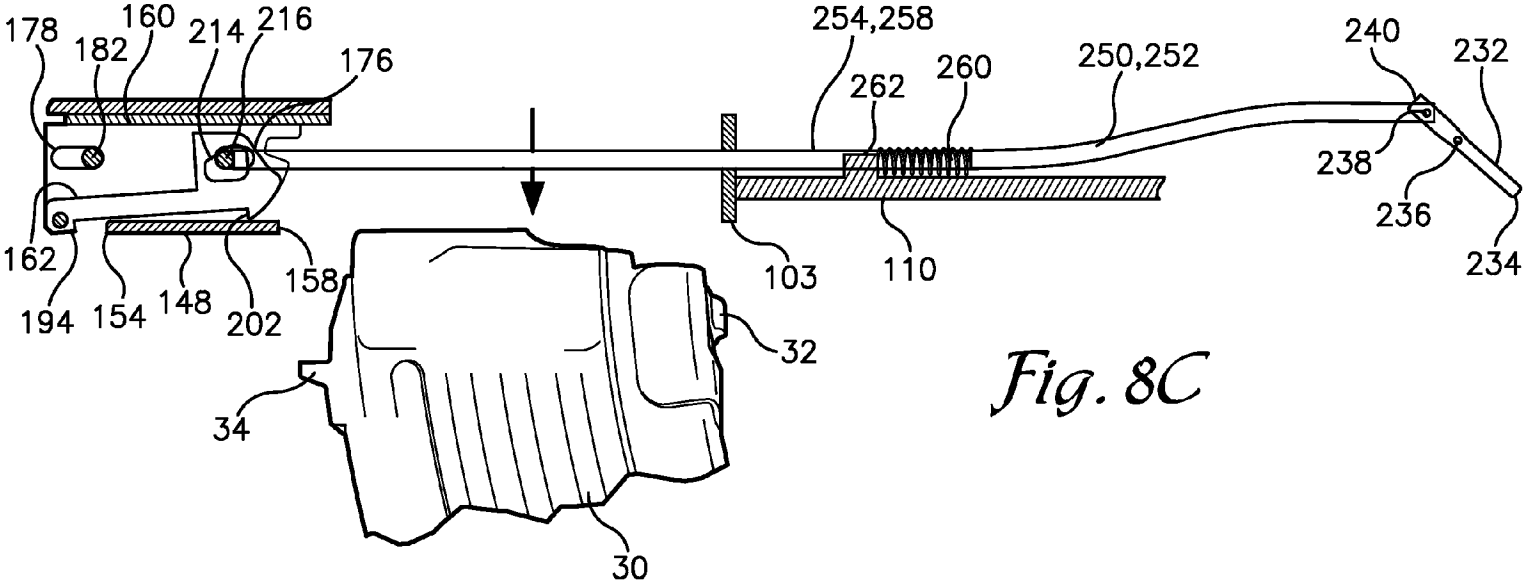
FIG. 8C is a diagram depicting a cutaway side view of the magazine latching assembly of FIG. 8A with a latch body and a locking member in a magazine-release position in accordance with an embodiment of the invention.

With additional reference to FIGS. 8A-C, operation of the magazine-latching assembly 102 of the firearm 100 to release a magazine 30 is described in accordance with an embodiment of the invention. Initially, the firearm 100 has a magazine 30 inserted and locked within the well 124 of the magazine receiver 103 as depicted in FIGS. 3 and 8A. The aft tab 34 of the magazine 30 extends within the notch 166 in the latch body 160 and the latch body 160 is in a forward position within the latch housing 126. The forward tab 32 of the magazine 30 is also supported on the lip 135 of the forward wall 130.

The locking member 162 is pivoted to a first or locking position in which the tooth 202 of the locking member 162 extends in front of and in closely spaced or abutting relationship with the forward edge 158 of the base plate 148 of the latch housing 126. The coil spring 186 biases the latch body 160 toward the forward position to maintain engagement of the latch body 160 with the aft tab 34 and to urge the forward tab 32 in overlapping relationship with the lip 135 while further biasing the locking member 162 into the locking position. As such, the overlapping engagement of the forward tab 32 on the lip 135 obstructs rotational movement of the magazine 30 about the aft tab 34, such as during stripping of an ammunition cartridge from the magazine 30 by the action of the firearm 100. At the same time, abutment of locking member tooth 202 against the base plate 148 of the latch housing 126 prevents rearward movement of the tooth 202, the locking member 162, and the latch body 160 (which is coupled to the locking member 162 by pin 196 extending through the aligned feet 172 and 194). Because the latch body 160 cannot move rearward when the locking member 162 is in the locked position, cradling of the aft tab 34 within the notch 166 of latch body 160 prevents rotational movement of the magazine 30 about the forward tab 32.

If the latch body 160 is not restrained from rearward movement by the locking member 162, recoil on the firearm 100 caused by firing a round of ammunition may occasionally cause the latch body 160 to be jarred rearwardly a sufficient distance to enable unintended withdrawal of the magazine 30 from the magazine well 124. Restriction of the rearward movement of the latch body 160 by the locking member 162 thus eliminates movement of the latch body 160 caused by recoil and thus eliminates unintended withdrawal of the magazine 30 during firing of the firearm 100.

To release the magazine 30 from the magazine receiver 103 the distal end 234 of the magazine-release lever 232 is pivoted forwardly. In the embodiment shown, the magazine-release lever 232 is pivoted by a user grasping the grip 104 in an operating hand (not shown) and extending a finger of the operating hand to press the magazine-release lever 232 forward without releasing the grasp of the grip 104 by the operating hand. The grip 104 and magazine-release lever 232 are disposed along the centerline of the firearm 100 such that the grip 104 can be held in the user's right or left hand for right- or left-handed operation of the firearm 100 and the magazine-release lever 232.

Pivoting the distal or lower end 234 of the magazine-release lever 232 forward about the first pivot pin 242 pivots the proximate end 240 and thus the clevis 246 rearwardly. Rearward movement of the clevis 246 operates to translate the actuation member 252 rearwardly and compress the coil spring 260. The contact surfaces 266 on the distal ends 264 of the arms 258 of the actuation member 252 contact opposite ends of the rod 216 and translate the rod or transverse linkage 216 rearwardly perpendicularly to the length of the rod 216.

As discussed previously, the rod 216 is disposed through elongate apertures 218 in the latch housing 126 and through the first apertures 176 in the latch body 160 and the actuation aperture 210 in the locking member 162. Thus, rearward translation of the rod 216 contacts the cam surface 214 of the actuation aperture 210 in the locking member 162 and pivots the locking member 162 about the pin 196 that couples the locking member 162 to the latch body 160. The locking member 162 is thereby moved to a second position depicted in FIG. 8B in which it is pivoted into the channel 188 in the latch body 160 and away from the base plate 148 of the latch housing 126 a sufficient distance to allow the tooth 202 on the locking member 162 to clear the forward edge 158 of the base plate 148.

Continued rearward translation of the rod 216 contacts a rear edge of the first aperture 176 in the latch body 160 and slideably moves the latch body 160 rearwardly within the latch housing 126 as depicted in FIG. 8C. Rearward movement of the latch body 160 first draws the magazine 30 slightly rearwardly a sufficient distance to disengage the forward tab 32 from the lip 135 on the forward wall 130 of the magazine well 124. The forward tab 32 thus engages or abuts the recessed channel 134 for sliding movement along the recess 134. In one embodiment, the forward tab 32 engages or overlaps the lip 135 by about 0.01 to about 0.1 inches, or preferably by about 0.02 to about 0.07 inches, or more preferably by about 0.05 inches. The rearward movement of the magazine 30 results from a slight frictional engagement between surfaces of the latch body 160 in the notch 166 and the aft tab 34. The rearward movement of the magazine 30 might also be aided by gravity among other forces acting on the magazine 30. Rearward movement of the latch body 160 continues a sufficient distance to disengage the aft tab 34 from the notch 166. The magazine 30 is then removable from the well 124.

The magazine 30 can be removed by pulling by hand or through gravity. Removal of the magazine 30 from the well 124 follows a path that is substantially perpendicular to the length of the firearm 100 and/or to the magazine receiver 103. No rocking or rotation of the magazine 30 about the forward tab 32 is required. Travel of the forward tab 32 out of the magazine well 124 follows the recessed channel 134 on the forward wall 130 of the well 124.

Upon release of the magazine 30 the magazine-release lever 232 is released by the user. The coil spring 260 biases the actuation member 252 forwardly to return to its original position and thus biases the distal or lower end 234 of the magazine-release lever 232 rearwardly toward its original position in which it contacts the trigger guard 222 and forms a second portion 226 thereof. And the coil spring 186 in the magazine-latching assembly 102 biases the latch body 160 back to the forward position and the locking member 162 to the first position with tooth 202 extending in engagement with the forward edge 156 of the base plate 148 of the latch housing 126 as depicted in FIG. 8A. The feet 172 and 194 on the latch body 160 and locking member 162 respectively restrict forward movement of the latch body 160 and locking member 162 beyond the forward position by engaging the aft end 154 of the base plate 148 of the latch housing 126.

Figure 9A:
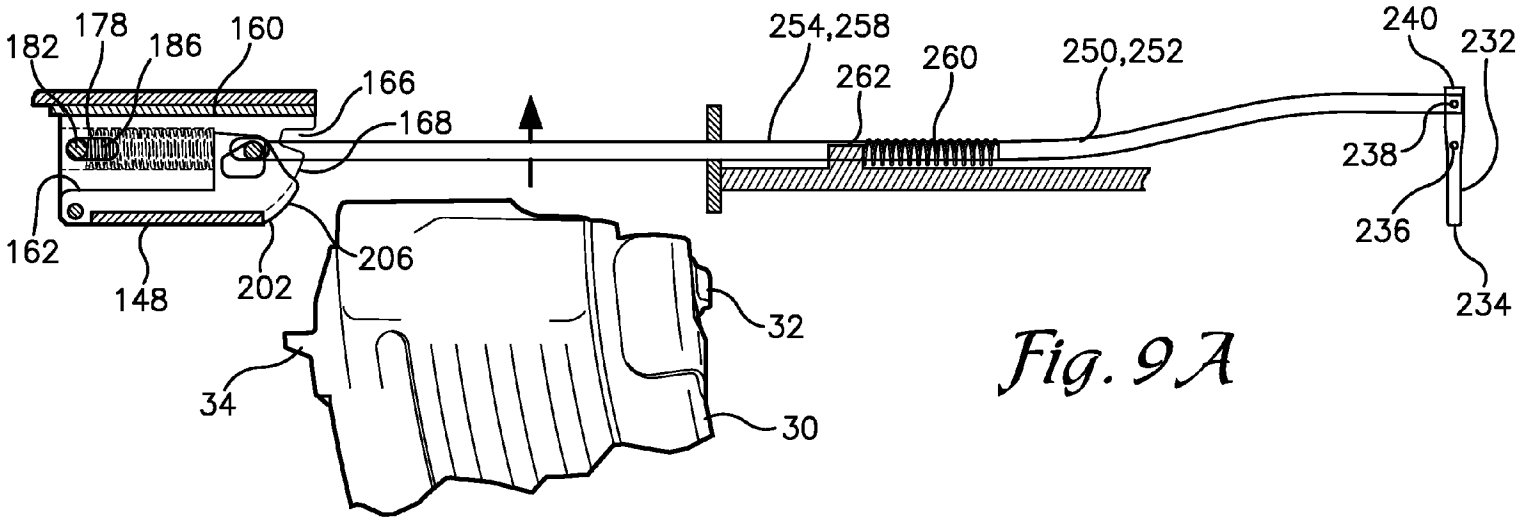
FIG. 9A is a diagram depicting a cutaway side view of the magazine latching assembly of the firearm of FIG. 3 in a locked position prior to insertion of a magazine into a magazine receiver well of the firearm in accordance with an embodiment of the invention.
Figure 9B:
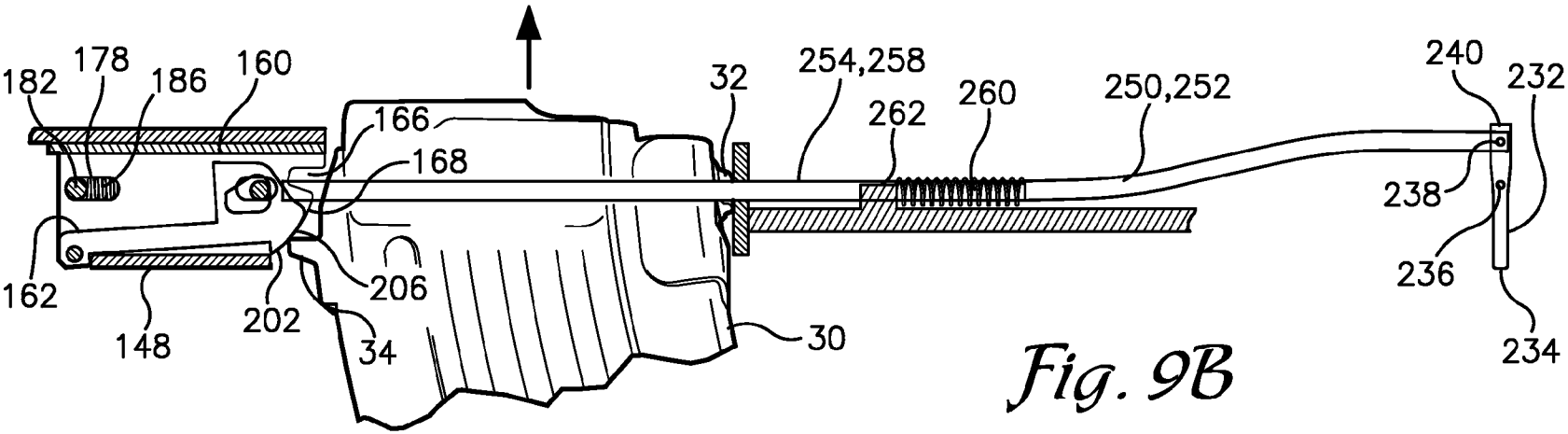
FIG. 9B is a diagram depicting a cutaway side view of the magazine latching assembly of FIG. 9A with a locking member moved to an unlocked position by contact with an aft tab on the magazine in accordance with an embodiment of the invention.
Figure 9C:
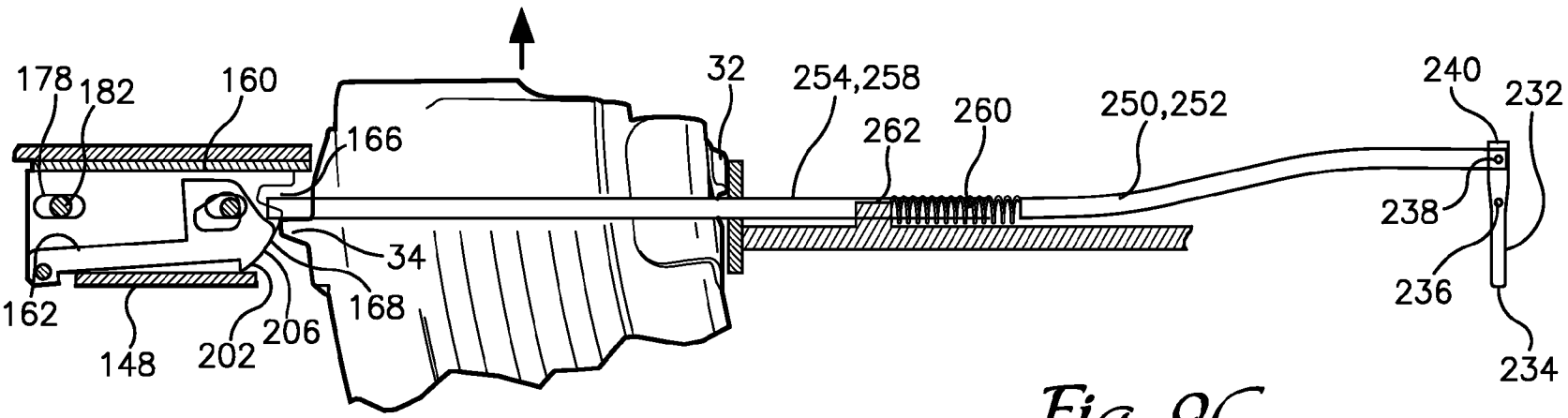
FIG. 9C is a diagram depicting a cutaway side view of the magazine latching assembly of FIG. 9A with a latch body moved rearwardly by contact with the aft tab on the magazine in accordance with an embodiment of the invention.

With reference now to FIGS. 9A-C, insertion of the magazine 30 into the well 124 of the magazine receiver 103 is described in accordance with an embodiment of the invention as shown. As depicted in FIG. 9A, the latch body 160 is initially in the forward position and the locking member 162 is in the first position with the tooth 202 thereof engaging the forward edge 156 of the base plate 148 of the latch housing 126.

The top end 40 of the magazine 30 is inserted into the well 124 following a path that is substantially perpendicular to the well 124 and/or the length of the firearm 100, e.g. no rotation or rocking of the magazine 30 is required. The forward tab 32 on the magazine 30 engages the recessed channel 134 and slideably follows the recessed channel 134 as the magazine 30 is inserted into the well 124.

The aft tab 34 first contacts the cam surface 206 of the locking member 162 prior to contacting the cam surface 168 on the latch body 160. The locking member 162 is thereby pivoted into the channel 188 in the latch body 160 and about the pin 196 from the first position to the second position in which the locking member cam surface 206 is generally aligned with the latch body cam surface 168. In the second position the tooth 202 of the locking member 162 is disengaged from the forward edge 156 of the base plate 148 of the latch housing 126 as depicted in FIG. 9B.

Once the locking member cam surface 206 and latch body cam surface 168 are aligned, further upward advancement of the aft tab 34 against and along the latch body cam surface 168 slidingly moves the latch body 160 rearwardly into the passage 140 of the latch housing as depicted in FIG. 9C. The magazine 30 is thereby allowed to pass into the magazine well 124 with the aft tab 34 in contact with the cam surface 168 of the latch body 160 and the forward tab 32 in contact with the recessed channel 134. The latch body 160 is moved rearwardly a sufficient distance to allow the aft tab 34 to pass by the cam surface 168 and align with the notch 166. Upon alignment with the notch 166, the coil spring 186 biases the latch body 160 to the forward position and engages the aft tab 34 in the notch 166, as depicted in FIG. 8A. The forward tab 32 travels past the lip 135 of the forward wall 130 and the forward movement of the latch body 160 also moves the magazine 30 slightly forwardly to advance a portion of the forward tab 32 over the lip 135. The slight forward movement of the magazine 30 is less than about 0.1 inches, or less than about 0.07 inches, or more preferably about 0.05 inches. The locking member 162 is also biased to pivot back into the first position in locking engagement with the base plate 148 of the latch housing 126. In a preferred embodiment, the locking member 162 cannot be fully pivoted to the first position until the magazine 30 is moved slightly forward to engage the forward tab 32 with the lip 135.

Throughout the insertion of the magazine 30 into the well 124 the magazine-release lever 232 and the actuation member 252 remain stationary with the actuation member 252 biased forwardly by the coil spring 260.

As described above, embodiments of the invention enable insertion and removal of the magazine 30 from the magazine receiver 103 in a substantially linear motion along a path that is substantially perpendicular to the magazine receiver 103 and the length of the firearm 100—the slight forward and rearward movement of the magazine 30 for engagement of the forward tab 32 with the lip 135 nearly imperceptible to a user. No rocking or rotation of the magazine 30 is required. And no initial alignment of the forward tab 32 with a flange in the receiver 103 is required. Thus, design clearances for any firearm utilizing the magazine-latching assembly 102 need not account for such rotation or rocking motions—the clearances can be much tighter than allowed by previous designs like the AK-47 10.

The use of the forward and aft tabs 32, 34 for retention of the magazine 30 in the magazine receiver 103 as described above might also aid in use of magazines 30 from a variety of suppliers. For example, magazines 30 produced for the AK-47 10 and similar firearms are made by a variety of manufacturers worldwide and thus have varied dimensions due to methods of manufacturing among others, e.g. a stamped steel magazine might have slightly different dimensions than a molded polycarbonate magazine. Only the dimensions of the top end 40 of the magazines 30, e.g. the placement of the forward and aft tabs 32, 34 are typically relatively constant. As such, the use of the forward and aft tabs 32, 34 to retain the magazine 30 in the firearm 100 without relying on other portions of the body of the magazine 30 enables use of magazines 30 with varied dimensions. And the mechanism of engagement of the forward and aft tabs 32, 34 as described above can also account for minor variations in dimensions and placement of the forward and aft tabs 32, 34.

In embodiments, the magazine-receiver 103 and the receiver well 124 are configured to provide additional clearance, or play, between the well 124 and the magazine 30. This additional clearance might further aid is easing the insertion and removal of the magazine 30 from the well 124 and might aid in use of magazines 30 of varied dimensions as described above.

Additionally, embodiments of the invention enable one-handed, ambidextrous operation of the magazine-latching assembly 102 to release a magazine 30 from the magazine receiver 103. As such, a user of the firearm 100 can release the magazine 30 with an operating hand without the operating hand releasing the grip 104 while a second hand obtains a second magazine for insertion into the magazine receiver 103. The first magazine 30, once released from the latch body 160, is allowed to fall from the receiver 103 in a direction generally perpendicular to the length of the firearm 100 under the force of gravity. The magazine 30 can simply slide from the receiver 103 without the need for rotation, rocking, or hanging up on flanges or other obstructions. The second magazine can subsequently be inserted into the receiver 103.

This transition or exchange of magazines 30 can occur at a quicker rate than that available from firearms like the AK-47 10. The transition also occurs without requiring the user to release the grip 104 or move the firearm 100 out of a fire-ready position—a much safer and combat-friendly operation.

Many different arrangements of the various components depicted, as well as components not shown, are possible without departing from the scope of the claims below. Embodiments of the technology have been described with the intent to be illustrative rather than restrictive. Alternative embodiments will become apparent to readers of this disclosure after and because of reading it. Alternative means of implementing the aforementioned can be completed without departing from the scope of the claims below. Certain features and subcombinations are of utility and may be employed without reference to other features and subcombinations and are contemplated within the scope of the claims.

What claimed is:

1. A magazine-latching assembly for a firearm for releaseably coupling to a magazine, the magazine-latching assembly comprising:

a receiver configured to accept the magazine, the magazine including a first tab;

a latch body slideably disposed in the receiver, the latch body having a latch-body aperture and being moveable forward and aft along the length of the firearm, and the latch body being biased in a first direction;

a notch disposed in a first surface of the latch body and configured to accept the first tab of the magazine;

a locking member pivotably coupled to the latch body and having a locking-member aperture with a locking-member cam surface; and a rod received by the locking-member aperture and the latch-body aperture and moveable by an actuation member, the rod being moveable in a second direction opposite the first direction by the actuation member to contact the locking-member cam surface and to pivot the locking member about a pivotal coupling with the latch body from a first position in which the locking member engages the receiver to a second position in which locking member is disengaged from the receiver, the rod being further moveable in the second direction to move the latch body in the second direction out of engagement with the first tab on the magazine.

2. The magazine-latching assembly of claim 1, further comprising:

a magazine-release lever pivotally coupled to a body of the firearm at a first pivot and pivotally coupled to the actuation member at a second pivot that is spaced apart from the first pivot.

3. The magazine-latching assembly of claim 2, wherein the magazine-release lever comprises a portion of a trigger guard of the firearm, and wherein the magazine-release lever is actuated by a finger of a user's trigger hand without the trigger hand releasing a grip associated with a trigger on the firearm.

4. The magazine-latching assembly of claim 3, wherein the magazine-release lever is located forward of the trigger of the firearm and is pivoted forwardly by the user's finger to release the magazine, the magazine being located rearwardly of the trigger.

5. The magazine-latching assembly of claim 1, wherein the actuating member includes a first section coupled to the magazine-release lever and a bifurcated second section having a pair of distal ends, the distal ends contacting the rod.

6. The magazine-latching assembly of claim 1, further comprising:

a latch-body cam surface disposed along the first surface of the latch body and configured to impart sliding movement of the latch body in the second direction via contact with the first tab of the magazine to enable insertion of the magazine into the receiver.

7. The magazine-latching assembly of claim 1, wherein the locking member further comprises a second cam surface that is contacted by the first tab of the magazine to pivot the locking member from the first position to the second position to enable insertion of the magazine into the receiver.

8. The magazine-latching assembly of claim 7, wherein the locking member is biased toward the first position.

9. The magazine-latching assembly of claim 1, wherein the receiver includes a well in which the magazine is received, a forward wall of the well having an edge interior to the well, the edge forming a lip that is engageable by a second tab on the magazine.

10. The magazine-latching assembly of claim 9, wherein the forward wall of the well includes a recessed channel that extends the height of the wall and terminates at the edge, the recessed channel being configured to partially accept the second tab therein and to guide movement of the second tab along the forward wall.

11. The magazine-latching assembly of claim 9, wherein the magazine is inserted into the receiver in a motion that is substantially perpendicular to the length of the firearm and without rocking or rotation of the magazine to engage the first tab with the notch in the latch body and the second tab with the lip on the wall of the well.

12. A method for releasing a magazine from a firearm, the method comprising:

moving a rod in a first direction along the length of the firearm, the rod being disposed transverse to the length of the firearm, the moving of the rod pivoting a locking member about a coupling with a latch body, disengaging the locking member from contact with a magazine receiver, and moving the latch body and the locking member in the first direction a sufficient distance to disengage a tab on the magazine from a tab-support surface on the latch body; and releasing the magazine from the magazine receiver.

13. The method of claim 12, further comprising:

pivoting a magazine-release lever about a first pivot;

moving an actuating member in the first direction, the actuating member being pivotally coupled to the magazine-release lever at a second pivot and being in contact with the rod.

14. The method of claim 13, wherein the magazine-release lever forms a portion of a trigger guard of the firearm and is located forward of a trigger of the firearm, and wherein the magazine is located rearward of the trigger.

15. The method of claim 12, wherein the magazine includes a second tab and moving the latch body and the locking member in the first direction draws the magazine in the first direction to disengage the second tab from engagement with a lip in the magazine receiver, and wherein releasing the magazine from the magazine receiver further comprises:

removing the magazine from the magazine receiver in a second direction that is substantially perpendicular to the first direction and without rocking or rotating the magazine about the tab or the second tab.

16. The method of claim 12, wherein the rod contacts a cam surface on the locking member to cause the pivoting of the locking member about the coupling with the latch body and contacts the latch body to move the latch body and the locking member in the first direction.

17. The method of claim 16, wherein the rod is disposed through a locking-member aperture in the locking member and a latch-body aperture in the latch body, the cam surface being formed by a portion of the perimeter of the locking-member aperture.

18. A method for loading a magazine in a firearm, the method comprising:

inserting a magazine into a magazine receiver on the firearm, the magazine being in a substantially perpendicular orientation to the magazine receiver, and the magazine having a first tab and a second tab extending from opposite sides thereof;

receiving the first tab in a recessed channel formed in an interior wall of the receiver, the first tab sliding along the recessed channel;

pivoting a locking member about a coupling with a latch body by contact of the second tab with the locking member, the pivoting disengaging the locking member from contact with the magazine receiver;

slideably translating the latch body in a first direction along the length of the firearm by contact of the second tab with a cam surface of the latch body as the magazine is moved into the magazine receiver;

slideably advancing the latch body in a second direction opposite the first direction upon passing of a tab-support surface on the latch body by the second tab to engage the second tab with the tab-support surface in an underlying relationship and to advance the magazine in the second direction to move the first tab into an overlapping relationship with a lip formed by a terminating edge of the recessed channel; and pivoting the locking member about the coupling with the latch body to engage the receiver body, the magazine being locked within the magazine receiver by engagement of the first tab with the lip on the edge of the recessed channel and engagement of the second tab with the tab-support surface on the latch body.

19. The method of claim 18, wherein the locking member is biased toward engagement with the receiver body.

20. The method of claim 19, wherein a coil spring biases the locking member and biases the latch body in the second direction.

21. A magazine-latching assembly for a firearm for releaseably coupling to a two-tabbed magazine, the magazine-latching assembly comprising:

a receiver having a magazine-receiving well formed therein configured to receive an end of the magazine;

a lip formed in said receiver at a first end of the magazine-receiving well;

a latch body having a tab-support surface and a cam surface, the latch body being slideably mounted relative to the receiver adjacent a second end of the receiver and opposite the first end for sliding movement between a latching position in which the latch body is advanced in a first direction toward the first end of the receiver and the cam surface extends into the magazine-receiving well and a retracted position in which the latch body is moved in a second direction away from the first end of the receiver and the cam surface and the tab-support surface are substantially withdrawn from the magazine-receiving well, the latch body being normally biased into the latching position; and a magazine-release assembly connected to a magazine-release actuator positioned proximate a trigger of the firearm, actuation of the magazine-release actuator causing the magazine-release assembly to move the latch body to the retracted position, wherein upon advancement of the end of the two-tabbed magazine into the magazine-receiving well, engagement of the cam surface of the latch body by a first tab on the magazine advances the latch body in the second direction until the first tab passes the tab support surface upon which the latch body is biased in the first direction to advance the tab support surface into an overlapping relationship with the first tab and to advance the magazine in the first direction to move at least a portion of a second tab on the magazine into overlapping relationship with the lip, and wherein upon subsequent advancement of the latch body to the retracted position by actuation of the magazine-release actuator, the tab support surface is drawn in the second direction out of overlapping relationship with the first tab such that the magazine is removable from the magazine-receiving well.

22. The magazine-latching assembly of claim 21, further comprising:

a locking member connected to the latch body and advanceable between a locking position and an unlocked position, the locking member normally biased into the locking position in which the locking member prevents the latch body from sliding from the latching position to the retracted position, the locking member advanceable to the unlocked position by the magazine-release assembly upon actuation of the magazine-release actuator, and the locking member advanceable to the unlocked position upon advancement of the first tab into the magazine-receiving well and against the locking member.

23. The magazine-latching assembly of claim 21, wherein the tab-support surface on the latch body defines an edge of a notch formed in the latch body and the latch body frictionally engages the first tab of the magazine positioned in the magazine-receiving well such that, upon advancement of the latch body to the retracted position, the latch body pulls the magazine in the second direction a distance sufficient to pull the second tab out of overlapping relationship with the lip.

* * * * *